United States Patent [19]

Schmid

[11] 4,422,831

[45] Dec. 27, 1983

[54] PUMP

[75] Inventor: Rolyn A. Schmid, Hayward, Wis.

[73] Assignee: Bender Machine Works, Inc., Hayward, Wis.

[21] Appl. No.: 317,168

[22] Filed: Nov. 2, 1981

[51] Int. Cl.[3] ..... F04B 21/00; F04B 39/00

[52] U.S. Cl. ..... 417/63; 417/440; 417/441

[58] Field of Search ..... 417/435, 440, 415, 63, 417/441

[56] References Cited

U.S. PATENT DOCUMENTS

| | | | |
|---|---|---|---|
| 1,343,574 | 6/1920 | Miller | 417/435 |
| 1,695,318 | 12/1928 | Buvinger et al. | 417/435 |
| 1,900,228 | 3/1933 | Dean | 417/435 |
| 2,808,786 | 10/1957 | Johnston | 417/435 |
| 2,847,149 | 8/1958 | Ainsworth | 417/435 |
| 2,973,779 | 3/1961 | Kennedy | 417/435 |
| 2,978,149 | 4/1961 | Roson | 417/440 |
| 3,610,784 | 10/1971 | Rundol | 417/415 |
| 3,612,722 | 10/1971 | Neward | 417/440 |

FOREIGN PATENT DOCUMENTS

| | | | |
|---|---|---|---|
| 1019883 | 11/1962 | United Kingdom | 417/415 |

*Primary Examiner*—William L. Freeh

*Attorney, Agent, or Firm*—James E. Nilles

[57] ABSTRACT

A piston type fluid pump which can maintain its prime even though the source of fluid from which the pump draws its supply becomes empty. The pump is capable of pumping its discharge into a pressure vessel as well as to the atmosphere if desired. The pump assembly includes a discharge chamber that receives discharged fluid from the pump and for ultimate delivery to the outflow of the pump assembly. The discharge chamber is of a volumetric size at least equal to or greater than the volume of the effective pumping chamber of the piston so that any air that enters the pumping chamber from the supply or inlet side of the pump remains at the top of the pumping chamber and is discharged into the discharge chamber and the pumping chamber remains full of fluid and consequently primed. The pump assembly is arranged so that the discharge chamber is located above the pumping chamber whereby fluid from the discharge chamber can flow back into the pumping chamber thereby filling the latter with fluid and maintaining it free of air.

2 Claims, 3 Drawing Figures

PUMP

BACKGROUND OF THE INVENTION

The present invention pertains to pumps of the piston type and for use, for example, in apparatus shown in my U.S. Pat. No. 4,015,618 of Apr. 5, 1977, or for example to supply a chlorine solution for swimming pools, as well as for many other uses. For example, small pumps have been used for cleaned-in-place dairy equipment and are referred to in U.S. Pat. No. 4,047,851 of Sept. 13, 1977 which has been assigned to an assignee common with said 4,015,618 patent and with the present application. One shortcoming of the bellows type pump shown in the '851 patent or the pump shown in the '618 patent was that it was impossible for those pumps to discharge into a pressure vessel or pressure line, but rather those pumps could only pump to an atmospheric container. Another short-coming of prior art pumps in general was that they did not maintain their prime particularly when the vessel from which they were drawing their supply fluid became empty. As a result it was often necessary to disassemble the pump and its lines, bleed air from the system, and then again prime the pump. Still a further disadvantage of prior art pumps was that they were not adjustable as to their output, particularly when they were required to pump either to a pressurized outlet or to atmosphere.

SUMMARY OF THE PRESENT INVENTION

The present invention provides a pump which maintains its prime even though the vessel from which it draws its supply of fluid becomes empty. The pump assembly of the present invention provides a discharge chamber for receiving the fluid discharged by a piston pump. This discharge chamber is located above the pumping chamber of the piston so that the discharge from the pumping chamber is at the upper end of the pumping chamber. By this means any air that is sucked into the pumping chamber through a one-way inlet valve remains in the upper portion of the pumping chamber and is disspelled from the pumping chamber before any fluid is discharged from the pumping chamber. The volumetric capacity of the discharge chamber is equal to or greater than the volumetric capacity of the pumping chamber so that when fluid is drawn into the pumping chamber from the input side, any air that is present in the pumping chamber rises to the top and is discharged through the discharge valve before any fluid is discharged through the discharge valve. This prevents air from accumulating in the piston chamber which would thereby cause the pump to lose its prime.

Another aspect of the invention relates to a pump of the above type in which the pump can discharge into a pressure vessel and maintain its prime and furthermore the flow of the pump can be infinitely adjustable down to zero flow by means of a fluid bypass valve. This adjustment of the discharge flow of the pump is possible whether the pump is installed to discharge into a pressure vessel or is installed to discharge into atmosphere. This bypass valve is operative even when the pump is pumping to atmosphere by the provision of an output adjusting valve which creates an artificial back pressure to thereby cause the bypass valve to become effective for any position to which it has been set.

Another aspect of the present invention is a pump assembly of the above type in which the piston is swivelly mounted on the spherical end of a piston rod which in turn is mounted in a ring driven by an eccentric. This provides an inexpensive construction which is easy to maintain.

These and other objects and advantages of the present invention will appear hereinafter as this disclosure progresses, reference being had to the accompanying drawings.

DESCRIPTION OF A PREFERRED EMBODIMENT

Figure 1:
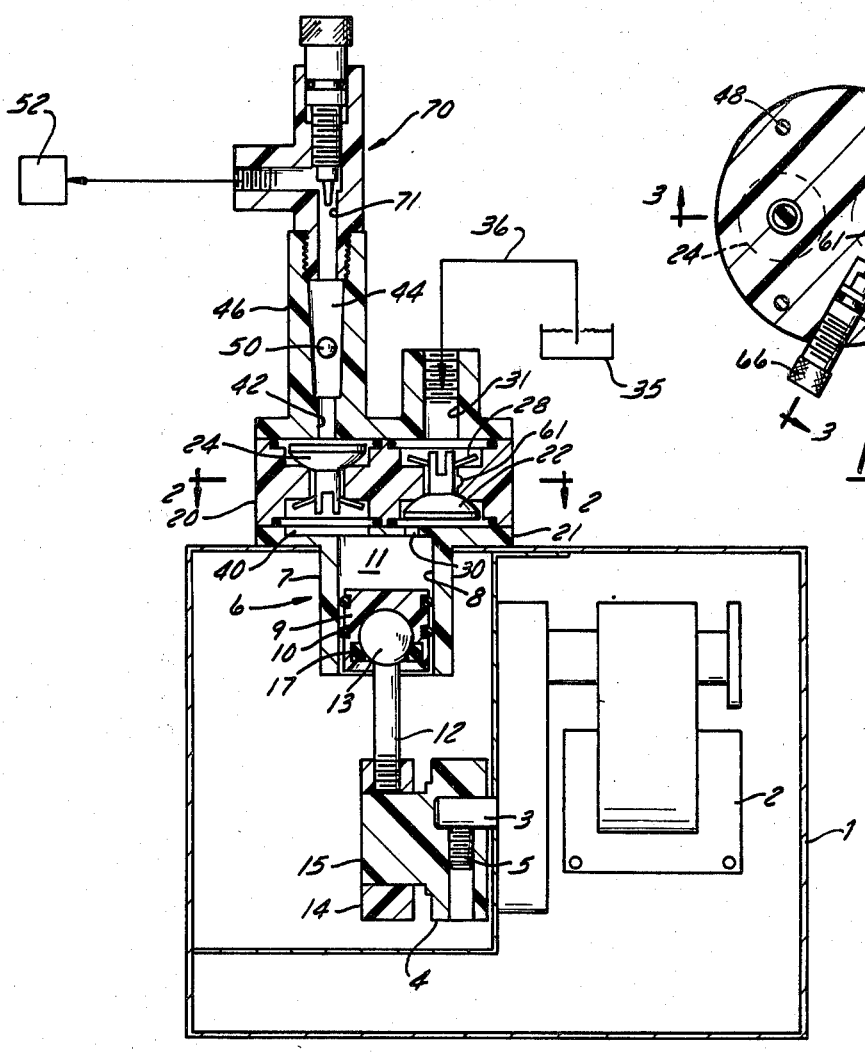
FIG. 1 is a cross-sectional view through a pump assembly made in accordance with the present invention.

The pump assembly is mounted in a case 1, more specifically a gear motor 2 has an output shaft 3 which drives the cam member 4 that is fixed thereto by the set screw 5. The gear motor 2 is an electric motor of the shaded pole type and for example of a 1/100th horsepower capacity. The pump 6 is formed by a cylinder 7 mounted in the case and having an internal chamber 8. The pump includes a reciprocable piston 9 having o-rings 10 on its periphery for sealing engagement with the internal chamber 8 to define an expansible pumping chamber 11. The piston is reciprocated in its chamber by means of its piston rod 12 having a spherical end 13 fixed thereon and the lower end of the piston rod is threadably engaged in a ring 14 that is mounted on the eccentric portion 15 of the cam. A packing gland 17 holds the piston on the spherical end of the rod 12 and as the eccentric 15 rotates, the spherical end 13 swivels in the interior of the piston and the piston is reciprocated in its chamber to effect pumping and suction strokes.

A valve block 20 is secured to the flange portion 21 of the cylinder 7 and an intake valve 22 is located in the valve block as is a discharge valve 24. Valves 22 and 24 are of similar construction and are shown and described in detail in U.S. Pat. No. 4,062,378 issued Dec. 13, 1977, and which is assigned to an assignee common with the present invention. It is believed sufficient to say that these shiftable valve elements 22 and 24 are formed of rubber or of other resilient material and have a generally conical section that is adapted to seat on the shoulders 25 and 26 in the valve block to thereby form a seal. These shiftable valve elements also have flexible ends 28 to hold them in assembled position in the valve block. An inlet passage 30 places the inlet passage 31 from the fluid supply in communication with the pumping chamber 11. Thus fluid can be drawn from a non-pressurized container 35 through the conduit 36 and past the one-way valve element 22 and into the pumping chamber. Valve element 22 of course prevents return flow from the chamber.

Figure 2:
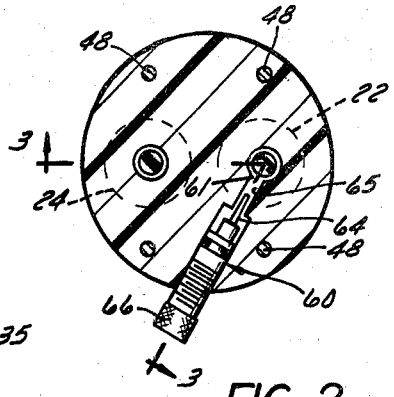
FIG. 2 is a cross-sectional view through the valve block taken generally along the line 2—2 in FIG. 1.
Figure 3:
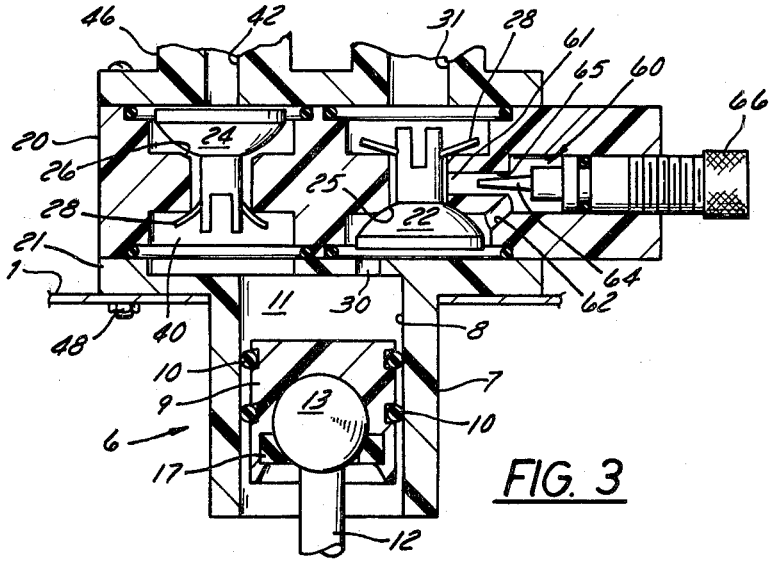
FIG. 3 is a sectional view taken along the line 3—3 in FIG. 2, but on an enlarged scale.

Turning now to the discharge side of the pump, the valve block 20 defines a discharge chamber 40 and this discharge chamber is of a volumetric size that is equal to or greater than the volume of the pumping chamber 11. Valve element 24 is positioned so as to permit flow of fluid from the pumping chamber 11 and discharge chamber 40 and to the discharge passage 42. This valve element 24 however prevents return flow from the discharge passage 42 into the pumping chamber. The discharge passage 42 includes an upwardly extending, tapered passage 44 formed in the upper portion 46 of the valve housing. Portion 46, valve block 20, and the cylinder 7 are all held together by bolt means 48 (FIGS. 2 and 3). A ball 50 is located in the passage 44 and can float in the fluid passing therethrough. Member 46 is transparent thus making the ball visible and its vertical position in passage 44 indicates the volume of flow passing therethrough. Fluid is then discharged from passage 44 and to a pressurized vessel 52. It should be noted however that as well as being able to pump into a pressurized vessel, the present pump can also discharge to atmosphere and still be adjustable as to its output as will more fully appear hereinafter.

The present pump is capable of maintaining its prime even though the container 35 that supplies the fluid may become empty. This is possible by having the discharge and particularly the discharge chamber 40 located above the pumping chamber 11 and is furthermore possible by making the discharge chamber 40 of a volumetric capacity which is equal to or greater than the pumping chamber 11. More specifically, if any air is drawn into the pumping chamber 11, it will rise to the top thereof and be discharged from from the pumping chamber when the piston commences its upward stroke before any fluid is discharged from the pumping chamber. In this manner air is prevented from accumulating in the pumping chamber and which would thereby cause the pump to lose its prime. Stated otherwise, any air trapped in the system would be discharged via valve element 24 and the remaining fluid in the pumping chamber 40 would flow back into and fill the pumping chamber 11.

The present invention also provides a pump of the above type in which the discharge of the pump may be varied down to zero flow and this is possible whether the pump is discharging into a pressure vessel or to atmosphere. For this purpose an adjustable bypass valve 60 is located in the valve block and is in communication at 61 with the inlet side of valve element 22 and is also in communication via port 62 with the pumping chamber 11. The bypass valve 60 includes a tapered end 64 which can be axially positioned in respect to passage 65 to vary the flow of fluid therethrough. In this manner by rotating the knob 66 in one direction or another, the amount of fluid permitted to flow from chamber 11 and to the inlet side of valve element 22 can be varied. If the valve element 64 is screwed all the way into passage 65 no flow can occur from pumping chamber 11 via port 62 and to the inlet side of the valve element 22.

With this arrangement when the pump is used to discharge into a pressure vessel 52, the amount of fluid that would be bypassed back to the supply side as compared with the amount of fluid discharged past the discharge valve element 24 would be determined by the position of the bypass valve 60. If the pump assembly was discharging to atmosphere then no fluid would be forced through the bypass valve 60. Therefore, in order to be able to use the adjustable bypass valve feature, under conditions when the pump is discharging to atmosphere, an output adjusting valve 70 is provided above the discharge valve element 24. The construction and operation of the valve 70 is similar to valve 60 and when valve 70 is threadably driven into its passage 71, flow past it is reduced or in other words, pressure at that discharge side is increased. In this manner, the valve 70 can create an artificial pressure even though the pump is discharging to atmospher so that the adjustable bypass valve 60 can be adjusted to any desired point to thereby regulate the amount of fluid bypassed from the pump and consequently regulate the rate of flow of the pump at the discharge side of the pump assembly.

With this arrangement, the output flow of the pump can be varied when the pump is discharging under pressure or to atmosphere. This is possible by means of the adjustable bypass valve when the pump assembly is discharging against pressure or by the use of the adjustable bypass valve 60 in combination with the output adjusting valve 70 when the pump assembly is discharging to atmosphere.

I claim:

1. A self-priming adjustable output pump assembly for supplying liquid from a source of supply either into a pressurized vessel maintained at some greater pressure greater than atmospheric or to atmosphere comprising: a piston type pump including a pumping chamber and a piston reciprocable therein, said pumping chamber having an inlet port and a discharge port at the upper end thereof, said discharge port being connected to a discharge passage which is connectable to said pressurized vessel or to atmosphere, means for reciprocating said piston in said pumping chamber to effect pumping and suction strokes, said pumping chamber having a maximum volumetric capacity at the end of a suction stroke and a minimum volumetric capacity at the end of a pumping stroke, a valve assembly including a one-way inlet valve for permitting one way flow of fluid from said source of supply through said inlet port into said pumping chamber during a suction stroke and also including a one-way discharge valve for permitting one-way flow of fluid from said pumping chamber through said discharge port to said discharge passage during a pumping stroke, a discharge chamber located between said discharge valve and said discharge port of said pumping chamber, the volumetric capacity of said discharge chamber being equal to or greater than the minimum volumetric capacity of said pumping chamber whereby any air that is drawn into said pumping chamber rises to the top thereof and is discharged through said discharge port, through said discharge chamber, through said discharge valve and through said discharge passage prior to liquid being discharged therethrough to thereby prevent air from accumulating in said pumping chamber and maintaining said pump in a primed condition, and means to vary the liquid flow from said pump comprising a by-pass passage communicating between the inlet side of said inlet valve and said pumping chamber and an adjustable by-pass valve for varying the amount of liquid flow through said by-pass passage from said pumping chamber to said inlet side of said inlet valve during a pumping stroke of said piston when liquid is being supplied to said pressurized vessel, said means further comprising an adjustable output valve for varying the amount of liquid flow through said discharge passage to increase fluid pressure therein to effect liquid flow from said pumping chamber through said by-pass passage to said inlet side of said inlet valve during a pumping stroke of said piston and thereby render said by-pass valve operative when liquid is being supplied to atmosphere.

2. A pump assembly according to claim 1 wherein said discharge passage is embodied in a member having a transparent portion and a member in said discharge passage at said transparent portion which is vertically displaceable in response to liquid flow through said discharge pump to provide a visual indication related to the rate of liquid flow.

* * * * *